US005243974A

United States Patent [19]

Allen

[11] Patent Number: 5,243,974

[45] Date of Patent: Sep. 14, 1993

[54] COLD TREATMENT ATHLETIC SUPPORTER

[76] Inventor: Marcus W. Allen, 1741 Shadewood La., San Diego, Calif. 92139

[21] Appl. No.: 983,327

[22] Filed: Nov. 30, 1992

[51] Int. Cl.[5] ..... A61N 1/00; A41B 9/00

[52] U.S. Cl. ..... 607/108; 2/403; 2/400; 2/406; 2/114; 2/247; 2/919; 128/891; 604/400

[58] Field of Search ..... 2/403, 400, 406, DIG. 7, 2/114, 247, 250, 252; 602/2, 67, 68, 70, 72, 73; 604/400; 128/891, 379, 386

[56] References Cited

U.S. PATENT DOCUMENTS

| | | | |
|---|---|---|---|
| 2,872,685 | 2/1959 | Denbo | 2/403 |
| 4,967,768 | 11/1990 | Tatro | 128/891 |
| 4,989,594 | 2/1991 | Doherty et al. | 602/72 |
| 5,038,779 | 8/1991 | Barry et al. | 2/102 |

*Primary Examiner*—Clifford D. Crowder

*Assistant Examiner*—Gloria Hale

*Attorney, Agent, or Firm*—Klein & Szekeres

[57] ABSTRACT

A garment in the general form of an improved athletic supporter includes a genital pouch depending from and attached to a waist band. The pouch comprises a front panel and a rear panel, joined at the bottom to form an open-top pocket. The respective top portions of the front and rear panels are provided with releasable fastening means, preferably hook-and-loop fasteners, so that the pocket can be selectively closed and reopened. A packet containing a chilling medium, such as ice, and conforming to the pocket, is inserted into the pocket. When the garment is worn with the chilling medium packet installed in the pocket, the chilling medium is held in close proximity to a surgical site or a site of mild trauma in the scrotal or inguinal area, thereby affording a degree of relief from pain and inflammation. The pouch offers genital support and limits the movement of the genitals, thereby reducing strain that can exacerbate the pain and inflammation and inhibit healing.

14 Claims, 1 Drawing Sheet

COLD TREATMENT ATHLETIC SUPPORTER

BACKGROUND OF THE INVENTION

This invention relates generally to the field of support garments. In particular, it relates to a combination athletic supporter and cold pack, for the treatment of pain in the groin and scrotal area of a human male.

Pain and inflammation in the groin or scrotal area of the human male are common after surgical procedures in that area, particularly vasectomies. Additionally, pain and inflammation may result from trauma to that area of the anatomy due to athletic or work-related activities. One common treatment for minor post-operative or traumatic pain and inflammation is to apply a cold compress or ice pack to the affected area. A drawback to this procedure is that the patient's movement is severely limited while the cold treatment is applied.

Heretofore, athletic supporters have been in common use to reduce the probability of injury to the scrotal, groin, or inguinal area. Furthermore, athletic supporters have been made with a top-opening pocket in the pouch that receives a rigid shield or "cup", for use in situations where additional protection for the male genitalia is desired. To applicant's knowledge, however, there has been no attempt to adapt or utilize an athletic supporter or the like for relieving pain and inflammation due to surgery or trauma.

There has thus been an unfulfilled need for a device that can be comfortably worn around the male genitalia, and which provides freedom of movement while also providing relief from pain and inflammation.

SUMMARY OF THE INVENTION

Broadly, the present invention is a pain and inflammation relieving garment, comprising an athletic supporter having a genital pouch, with a sealable pocket in the front of the pouch, the pocket containing a chilling medium. The chilling medium may be an ice pack, a cold compress, or even crushed ice. Preferably, the pocket opens at the top, and is sealable with hook-and-loop fastening material, e.g., of the type marketed under the trademark "VELCRO".

The athletic supporter is worn as one would wear an ordinary supporter. It provides support for the male genitalia, and offers the usual degree of protection from injury and trauma. In addition, the cooling effect of the chilling medium held closely proximate to the genitalia and the inguinal area provides relief from pain and inflammation due to surgery or trauma. Furthermore, the pain and inflammation relief effect is provided in a manner which allows freedom of movement.

DETAILED DESCRIPTION OF THE PREFERRED EMBODIMENT

Figure 1:
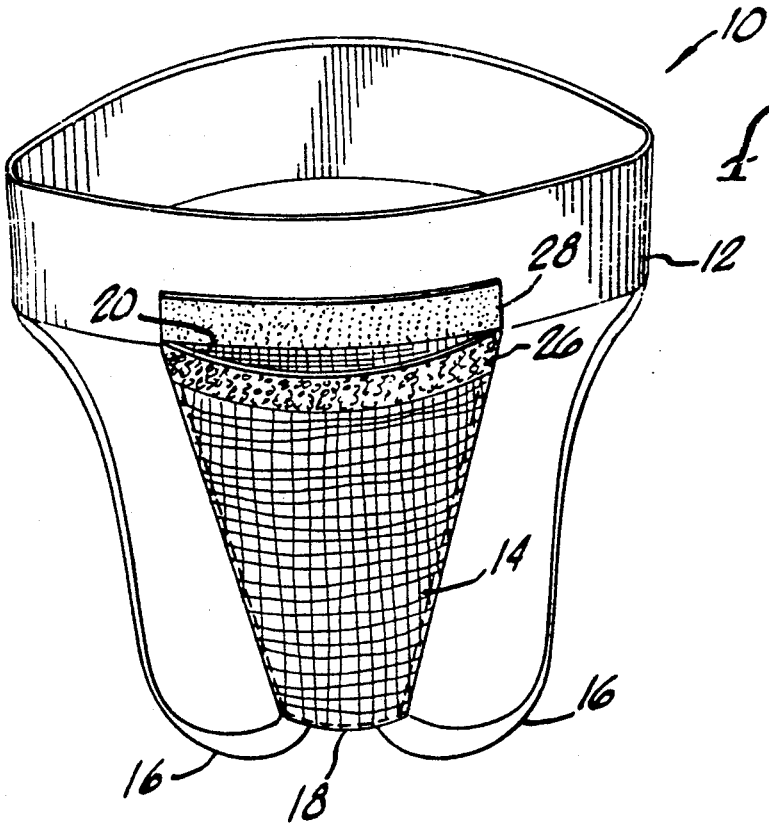
FIG. 1 is a front elevational view of a pain and inflammation relieving garment in accordance with a preferred embodiment of the present invention.
Figure 2:
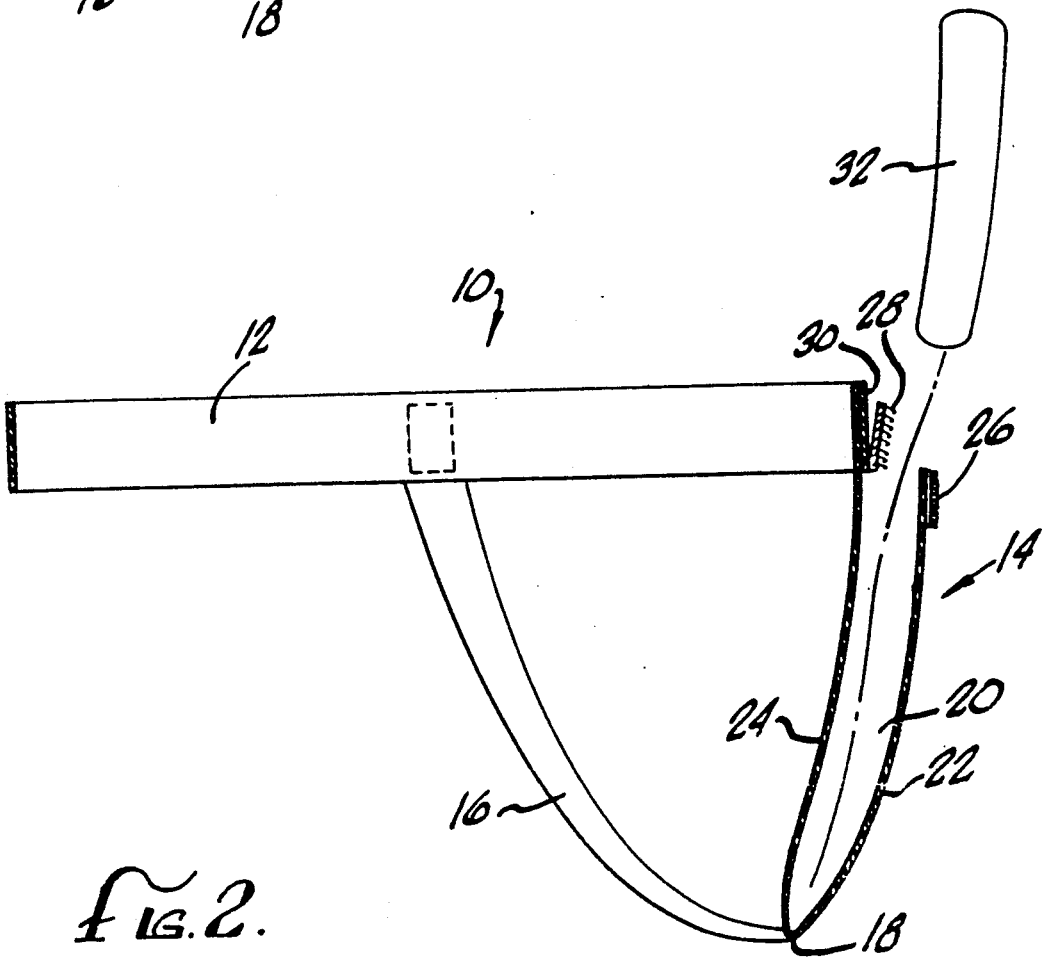
FIG. 2 is a cross-sectional view, taken along line 2—2 of FIG. 1, showing a chilling medium packet insertable into the front pocket of the garment.

Referring now to the drawings, a pain and inflammation relieving garment 10, in accordance with a preferred embodiment of the invention, is shown. The garment 10 is in the form of an athletic supporter, comprising an elastic waist band 12, a genital pouch 14 attached at the top to the front of the waist band 12 and depending downwardly therefrom, and a pair of thigh straps 16 connecting the bottom of the genital pouch 14 to opposite sides of the waist band 12, at positions removed from the top of the pouch 14. The pouch 14 is preferably made of lightly-padded cotton or nylon, and it may be elasticized in a conventional manner.

The pouch 14 is formed with a bottom fold 18 so as to form a top-opening pocket 20 defined between a front panel 22 and a rear panel 24. The pocket 20 is sealable by means such as a fibrous hook-and-loop fastener, of the type marketed under the trademark "VELCRO". Specifically, in the illustrated embodiment, a first closure element comprising a first closure strip 26 of fibrous loop material, is sewn or adhesively attached across the top of exterior surface of the front panel 22. A second closure element comprises a second closure strip 28 of fibrous hook material that is sewn or otherwise attached along its top edge to a fabric attachment strip 30 that is sewn or adhesively attached to the top of the rear pouch panel 24, at its juncture with the front of the waist band 12. The second closure strip 28 thus forms a hinged closure flap that can be folded down over the first closure strip 26, thereby allowing the selective closing and reopening of the pocket 20 by the releasable sealing engagement between the fibrous loop fastener material of the first closure strip 26 and the fibrous hook fastener material of the second closure strip 28.

As alternatives to the closure strips 26 and 28, snap fasteners, buttons, or a zipper can be used to close the pocket 20. Nevertheless, the closure strips 26 and 28 are considered to be the best mode of practicing the invention.

The pocket is sized and configured to receive a conforming packet 32 containing a suitable chilling medium, which, in the preferred embodiment, is ice or one of the common, commercially available ice substitutes, of the type used in picnic coolers and the like.

In use, a wearer who has undergone surgery (such as a vasectomy) in the scrotal or inguinal area, or who has suffered a mild trauma to that area, and who is experiencing pain or inflammation, is offered analgesic relief by wearing the garment 10 with the chilling medium packet 32 inserted into the pocket 20, the pocket 20 being sealed by means of the closure strips 26 and 28. The wearer is thus free to walk or otherwise move about (medical condition permitting), while the chilling medium is maintained in close proximity to the site of the pain or inflammation. In addition, the genital support offered by the pouch 14, in limiting stressful motion of the genitals, reduces the risk of further injury, while enhancing the effects of relieving pain and inflammation.

Of course, the garment 10, without the packet 32, can be worn as an ordinary athletic supporter, or the pocket 20 can be used to contain a cup (not shown). Moreover, the garment 10 can be worn by a female, for the application of cold treatment to a surgical site or a trauma site in the groin or genital area.

While a preferred embodiment of the invention has been described above and illustrated in the drawings, a number of variations and modifications (some of which have been described above) may suggest themselves to those skilled in the pertinent arts. Such variations and modifications should be considered within the spirit and scope of the present invention, as defined in the claims that follow.

What is claimed is:

1. A garment to be worn for the relief of pain and inflammation, comprising:

a waist band;

a rear panel forming a genital pouch depending from the waist band, the rear panel having a rear top portion attached to the waist band, and a rear bottom portion;

means for connecting the bottom portion of the rear panel to the waist band;

a front panel having a front top portion, and having a front bottom portion joined to the rear bottom portion along a bottom edge, thereby defining a top-opening pocket between the front and rear panels;

closure means, on the pocket, for selectively closing and reopening the pocket; and a packet containing a chilling medium disposed within the pocket.

2. The garment of claim 1, wherein the closure means comprises:

first releasable fastener means on the front top portion; and second releasable fastener means on the rear top portion.

3. The garment of claim 2, wherein the rear top portion comprises:

an upper strip attached to the waist band; and a lower strip attached to the upper strip along an edge so as to form a hinge along the edge.

4. The garment of claim 3, wherein the second fastener means is attached to the lower strip.

5. The garment of claim 1, wherein the closure means comprises hook-and-loop fastening means.

6. The garment of claim 1, wherein the rear top portion comprises:

an upper strip attached to the waist band; and a lower strip attached to the upper strip along an edge, so as to form a hinge along the edge, the lower strip being foldable over the front top portion.

7. The garment of claim 6, wherein the hook-and-loop fastening means are disposed on the lower strip and on the first top portion.

8. An athletic supporter, of the type having a genital pouch attached to a waist band, wherein the improvement comprises:

a front panel having a front top portion and a front bottom portion;

a rear panel joined to the front bottom portion and having a rear top portion attached to the waist band, whereby a top-opening pocket is formed between the front and rear panels; and a packet containing a chilling medium disposed within the pocket.

9. The athletic supporter of claim 8, wherein the improvement further comprises:

closure means on the pouch for selectively closing and reopening the pocket.

10. The athletic supporter of claim 9, wherein the closure means includes a hook-and-loop fastener means.

11. The athletic supporter of claim 8, wherein the rear top portion comprises:

an upper strip attached to the waist band; and a lower strip attached to the upper strip along an edge so as to form a hinge along the edge, whereby the lower strip is foldable over the front top portion.

12. The athletic supporter claim 11, further comprising:

first releasable fastener means on the front top portion; and second releasable fastener means on the lower strip of the rear top portion.

13. The athletic supporter of claim 12, wherein the first and second fastener means include hook-and-loop fastener means.

14. A garment to be worn for the relief of pain and inflammation, comprising:

a waist band;

a rear fabric panel forming a genital pouch depending from the waist band, the rear panel having a top portion attached to the waist band, and a bottom portion;

thigh strap means for connecting the bottom portion of the rear panel to the waist band at positions removed from the top portion of the rear panel;

a front fabric panel having a bottom portion joined to the bottom portion of the rear panel, thereby defining an open-top pocket between the rear and front panels;

a first strip including fibrous hook-and-loop fastener means on the top portion of the front panel;

a second strip including fibrous hook-and-loop fastener means attached to the top portion of the rear panel along an edge, so as to form a hinged flap, the flap being foldable over the first strip to releasably engage the first strip;

a packet containing a chilling medium contained within the pocket defined between the front and rear panels.

* * * * *